US008046959B2

(12) United States Patent
Stoetzer et al.

(10) Patent No.: US 8,046,959 B2
(45) Date of Patent: Nov. 1, 2011

(54) CONSTRUCTION APPARATUS WITH PIVOTABLE MAST

(75) Inventors: Erwin Emil Stoetzer, Aichach (DE); Leonhard Weixler, Thierhaupten (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 360 days.

(21) Appl. No.: 12/457,345

(22) Filed: Jun. 8, 2009

(65) Prior Publication Data

US 2009/0320385 A1 Dec. 31, 2009

(30) Foreign Application Priority Data

Jun. 13, 2008 (DE) ..... 20 2008 007 970 U

(51) Int. Cl.
*B66C 23/06* (2006.01)
*B66C 23/42* (2006.01)

(52) U.S. Cl. ..... 52/116; 52/118; 52/119; 212/297; 212/299; 212/347

(58) Field of Classification Search ..... 52/118, 52/116, 117, 111, 119; 212/297, 299, 300, 212/304, 347; 254/8 B, 9 B, 2 B; 248/631, 248/618
See application file for complete search history.

(56) References Cited

U.S. PATENT DOCUMENTS 2,052,301 A * 8/1936 Johansen ..... 173/188
2,151,057 A * 3/1939 Suth ..... 254/93 R
3,845,596 A * 11/1974 Veenstra ..... 52/118
4,465,425 A * 8/1984 Schwappach ..... 414/685
4,547,110 A * 10/1985 Davidson ..... 414/22.55
4,708,581 A 11/1987 Adair
4,759,414 A 7/1988 Willis
4,798,512 A * 1/1989 Intveld ..... 414/722
6,405,492 B1 6/2002 Scheid et al.
6,991,120 B2 * 1/2006 Gaillard ..... 212/297

FOREIGN PATENT DOCUMENTS

DE 4436264 C1 11/1995
DE 29718149 U1 1/1998
EP 1077306 A2 2/2001
GB 1452341 A 10/1970
JP 5202686 A 8/1993
JP 2002285775 A 10/2002
RU 16516 U1 1/2001
RU 2191156 C2 10/2002

* cited by examiner

*Primary Examiner* — Robert Canfield
*Assistant Examiner* — Brent W Herring
(74) *Attorney, Agent, or Firm* — Jacobson Holman PLLC

(57) ABSTRACT

The invention relates to a construction apparatus comprising a base carrier, a mast which is arranged on the base carrier in a pivotable manner, a first hydraulic cylinder and a second hydraulic cylinder for erecting the mast, which are connected to each other in an articulated manner in a connecting section, the first hydraulic cylinder being linked to the base carrier and the second hydraulic cylinder being linked to the mast, and a coupling rocker-arm which is linked on one side to the mast and on another side to the connecting section. According to the invention in the part of the connecting section a spacer is arranged, through which the connecting section is supported on the mast in a detachable manner.

11 Claims, 6 Drawing Sheets

CONSTRUCTION APPARATUS WITH PIVOTABLE MAST

Figure 1:
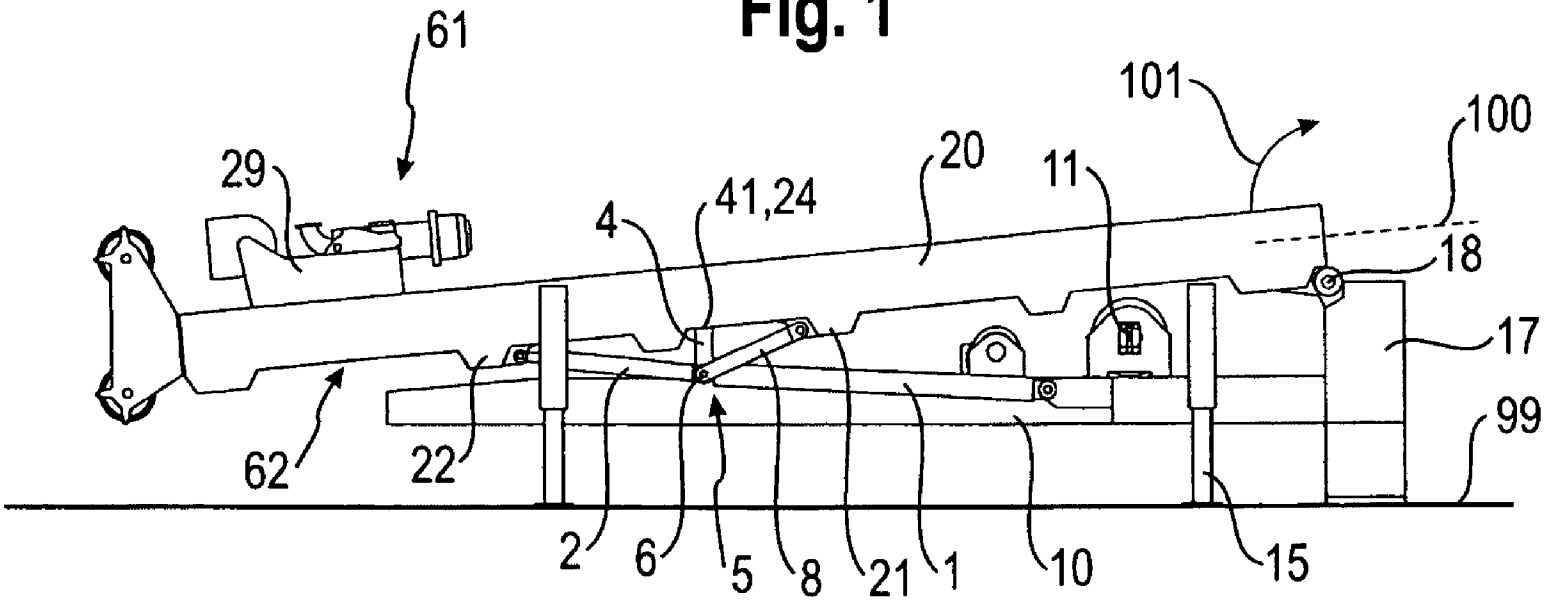

The invention relates to a construction apparatus comprising a base carrier, a mast which is arranged on the base carrier in a pivotable manner, a first hydraulic cylinder and a second hydraulic cylinder for erecting the mast, which are connected to each other in an articulated manner in a connecting section, the first hydraulic cylinder being linked to the base carrier and the second hydraulic cylinder being linked to the mast, and a coupling rocker-arm which is linked on one side to the mast and on the other side to the connecting section.

A generic construction apparatus is known from U.S. Pat. No. 4,708,581. According to this printed publication use is made of a generic twin-cylinder arrangement for erecting and folding a transfer arm which has a mast-like section. The drilling mast proper is erected by means of a telescopic cylinder.

Another construction apparatus with a mast, on the holder of which two hydraulic cylinders are arranged in series, is known from JP 05-202686 A.

JP 2002-285775 A discloses a construction apparatus, the mast of which is of telescopic design and can be pivoted by means of a hydraulic cylinder about a horizontal pivot axis.

The object of the invention is to improve a generic construction apparatus in such a manner that a particularly high reliability and efficiency is achieved.

The object is solved in accordance with the invention by a construction apparatus having the features of claim 1. Preferred embodiments are stated in the dependent claims.

The construction apparatus according to the invention is characterized in that in the part of the connecting section a spacer is arranged, through which the connecting section is supported on the mast in a detachable manner.

In accordance with the invention two erecting cylinders coupled in series are provided for erecting the mast, the cylinders being connected to each other via a coupling rocker-arm that is linked to the mast. In such an arrangement the first hydraulic cylinder is linked in the corner part of a triangle formed by the second hydraulic cylinder, the coupling rocker-arm and a mast section extending between the second hydraulic cylinder and the coupling rocker-arm.

The invention is based on the finding that in the case of such a cylinder arrangement relatively high forces may have to be applied in particular at the onset of the erecting process. The reason for this can reside in the fact that at the beginning of the erecting process the hydraulic cylinders, and in particular the second hydraulic cylinder, extend at a comparatively small angle to the longitudinal axis of the mast. Therefore, the force vector applied by the cylinders extends at a small angle to the longitudinal axis of the mast so that the force component that acts transversely to the longitudinal axis of the mast and therefore in the erecting direction is correspondingly small.

A fundamental idea of the invention resides in a spacer, by means of which the connecting section located between the second hydraulic cylinder and the coupling rocker-arm can be supported on the mast in the starting phase of the erecting process. The spacer allows for an additional introduction of force from the connecting section into the mast and can thus relieve the second hydraulic cylinder but also the coupling rocker-arm. In particular, the spacer can be arranged in a steep manner to the longitudinal axis of the mast, preferably it can be arranged at an angle of at least approximately 90° to the longitudinal axis of the mast so that the force vector transmitted through the spacer can be directed at least approximately in the erecting direction. Since there is no need for any unnecessary force components to be applied perpendicularly to the erecting direction, the forces to be applied are comparatively small and the hydraulic cylinders are load-relieved. In particular, the hydraulic cylinders can thus be designed for smaller operating forces whilst having the same weight of the mast so that the purchasing costs are reduced.

In accordance with the invention the connecting section is supported on the mast in a detachable manner. Hence, the contact made via the spacer between the connecting section and the mast can be detached, if the introduction of force effected through the spacer into the mast is no longer required in particular at a late stage of the erecting process. In the simplest case, for a detachable connection the spacer rests on the mast or on the connecting section, i.e. the mast or the connecting section forms a stop for the spacer, which limits a further movement of the spacer towards the mast or the connecting section, whilst still permitting a detachment of the spacer through a movement away from the mast or the connecting section. According to this embodiment the spacer is only kept under pressure but not, however, kept under tension by the mast or the connecting section. Basically, for a more complex force transmission a locking device can also be provided, with which the spacer is detachably kept both under pressure and under tension on the mast or the connecting section.

The base carrier concerned here can be a carrier vehicle for example or a superstructure that can be mounted in a detachable manner on a carrier vehicle. By preference, the base carrier has an at least approximately horizontally extending frame. On the base carrier a rope winch for moving a drilling sledge longitudinally of the mast can also be provided. Advantageously, the mast is arranged on the base carrier in a pivotable manner about a horizontally extending axis. In particular, the mast can be pivoted from an at least approximately horizontally extending transport position into an at least approximately vertically extending operating position. According to the invention the first hydraulic cylinder is linked to the base carrier on its end facing away from the connecting section and the second hydraulic cylinder is linked to the mast on its end facing away from the connecting section. It is especially preferred that the first hydraulic cylinder is linked on its cylinder housing to the base carrier and/or that the second hydraulic cylinder is linked on its piston rod to the mast. As a result, the forces to be applied can be reduced further.

Basically, provision can be made for the spacer to be arranged on the mast. However, it is especially preferred that the spacer is fixed to the connecting section, in particular fixed thereto in an articulated manner. According to this embodiment the spacer is provided in a detachable manner with respect to the mast and moves together with the connecting section when the latter moves away from the mast during the erection of the mast. This embodiment can be realized in a particularly simple way from a constructional point of view.

Another preferred embodiment of the invention resides in the fact that the spacer is connected in a rotationally fixed manner to the coupling rocker-arm. In this way it can be ensured in an especially simple and efficient way that during the retraction of the second hydraulic cylinder the spacer automatically assumes its correct position for resting on the mast. In particular, provision can be made for the spacer to be pivotable relative to the first hydraulic cylinder and to the second hydraulic cylinder.

Alternatively, provision can be made for the spacer to be connected in a rotationally fixed manner to the second hydraulic cylinder, in which case the spacer can then be pivotable relative to the coupling rocker-arm.

The spacer can be arranged for example on the second hydraulic cylinder. With regard to the constructional work involved it is especially preferred that the spacer is arranged on the coupling rocker-arm.

The constructional work involved can be reduced further in that the spacer is arranged at the end of the coupling rocker-arm. In this case it is useful that the coupling rocker-arm and the spacer jointly form an L-shape, with the angle enclosed by the spacer and the coupling rocker-arm being preferably smaller than 90°.

With regard to the effort involved in manufacture it is furthermore preferred that the spacer is formed integrally with the coupling rocker-arm. According to this embodiment the spacer and the coupling rocker-arm are connected to each other in a fixed manner and consist of the same material.

The constructional work involved can be reduced further in that the spacer has at its front face a supporting surface for support on the mast. For instance the spacer can have a cylindrical or cuboid design.

Advantageously, the spacer is designed shorter than the coupling rocker-arm. Basically, on the mast a corresponding second spacer can be provided, on which the spacer according to the invention comes to rest.

Moreover, as far as the force take-up is concerned it is of advantage that the two hydraulic cylinders and the coupling rocker-arm are linked to each other coaxially in the connecting section. According to this embodiment a common pivot axis is provided for the two hydraulic cylinders and the coupling rocker-arm, through which the cylinders and the rocker-arm are connected to one another. Advantageously, in the connecting section the piston rod of the first hydraulic cylinder is connected to the cylinder housing of the second hydraulic cylinder.

Another preferred embodiment resides in the fact that the spacer extends at least approximately rectangularly to a longitudinal axis of the mast when the connecting section is supported by the spacer on the mast. According to this embodiment forces directed transversely to the longitudinal axis of the mast, i.e. directed in the erecting direction, can be introduced in an especially efficient way via the spacer into the mast. The rectangular arrangement of the spacer proves to be particularly advantageous at that point in time when the connecting section is supported by the spacer on the mast, i.e. when the connecting section rests through the spacer on the mast. At that time when the spacer does not assume a supporting function and at which the spacer is spaced from the mast, a different angular position of the spacer can be provided, too.

The constructional work involved can be reduced further in that the mast has a first projection to which the coupling rocker-arm is linked and in that the mast has a second projection to which the second hydraulic cylinder is linked. Advantageously, between the projections a contact surface is provided for the spacer. The linkage points located on the mast for the second hydraulic cylinder and the coupling rocker-arm preferably have approximately the same distance to the longitudinal axis of the mast. By preference, the contact surface is displaced with respect to these linkage points and/or the projections towards the longitudinal axis of the mast.

Another preferred embodiment of the invention resides in the fact that the second hydraulic cylinder and the coupling rocker-arm are linked to the mast on a mast's rear side facing towards the first hydraulic cylinder. This proves to be particularly advantageous with regard to the introduction of force into the mast and for geometrical reasons.

Furthermore, according to the invention it is especially preferred that, in particular on a mast's front side facing away from the first hydraulic cylinder, a drilling sledge is arranged which can be displaced longitudinally of the mast. On the drilling sledge a drill drive for actuating a drill rod is suitably provided, which can be a rotary drive in particular.

Moreover, it is especially useful that the first hydraulic cylinder has a greater stroke than the second hydraulic cylinder. As a result, especially compact dimensions can be realized. For best suitability, the first hydraulic cylinder is longer than the second hydraulic cylinder.

Especially where the dimensions of the devices are concerned, it is furthermore advantageous for the spacer to be designed shorter than the coupling rocker-arm.

To erect the mast of a construction apparatus according to the invention a method can be provided, in which the first hydraulic cylinder is initially extended, more particularly to completion, while the coupling rocker-arm is supported through the spacer on the mast and afterwards the second hydraulic cylinder is extended while the spacer moves away from the mast. In particular, provision can be made for the coupling rocker-arm to turn during the extension of the second cylinder and to move away from the mast, preferably together with the spacer.

In the following the invention will be described in greater detail by way of preferred embodiments shown schematically in the accompanying Figures, wherein FIGS. 1 to 6 show an embodiment of a construction apparatus according to the invention in different stages during the erection of the mast in side view.

Figure 3:
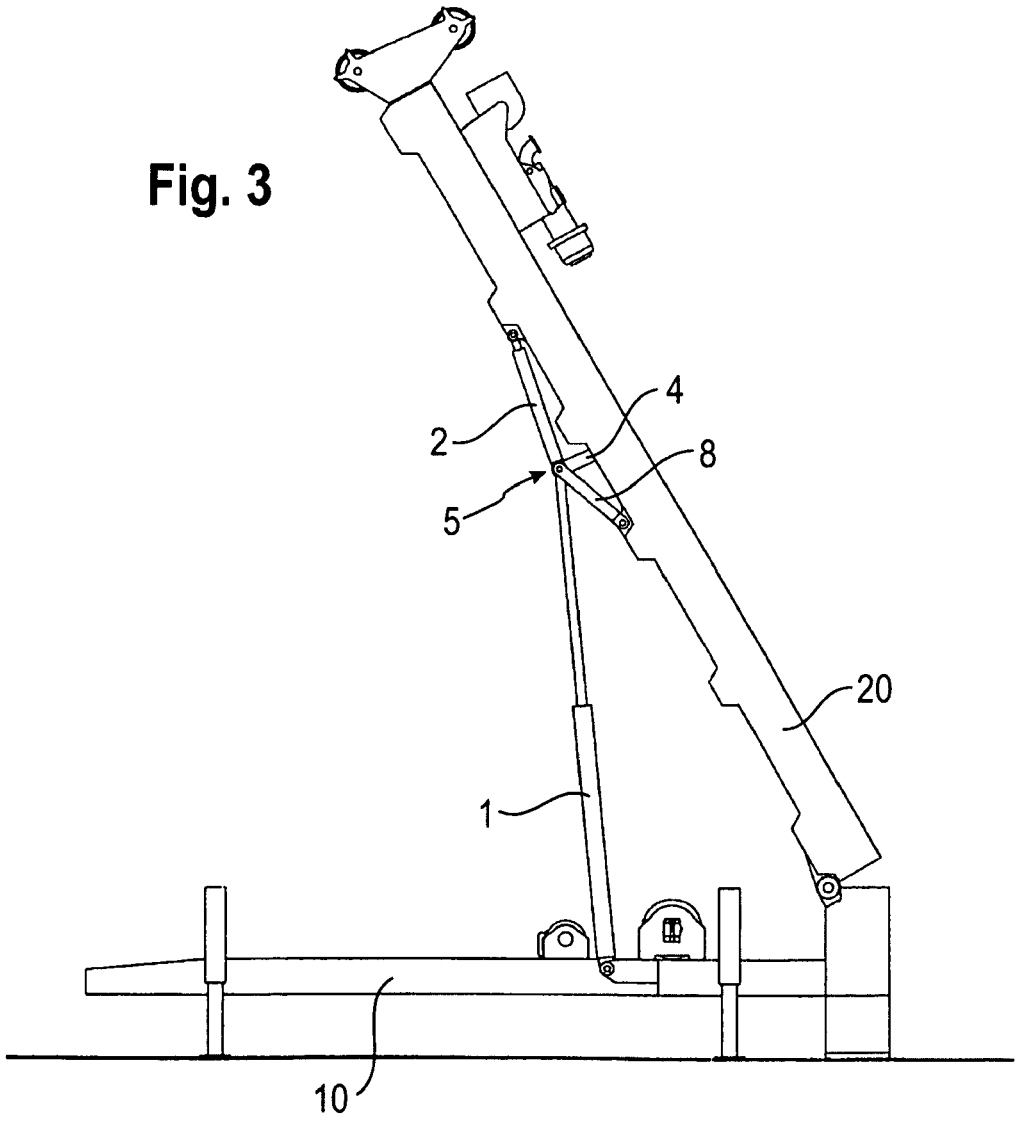
Figure 4:
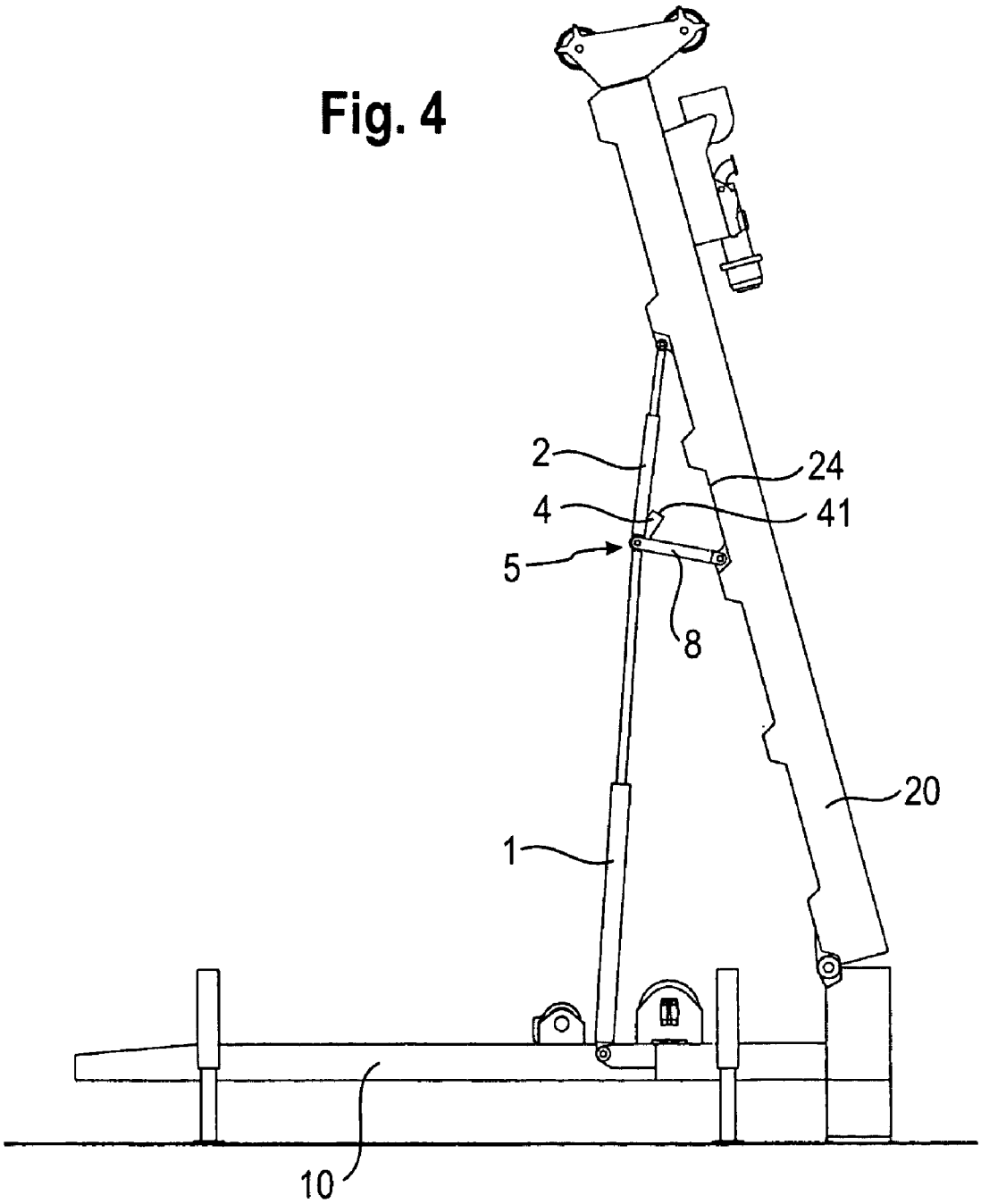
Figure 5:
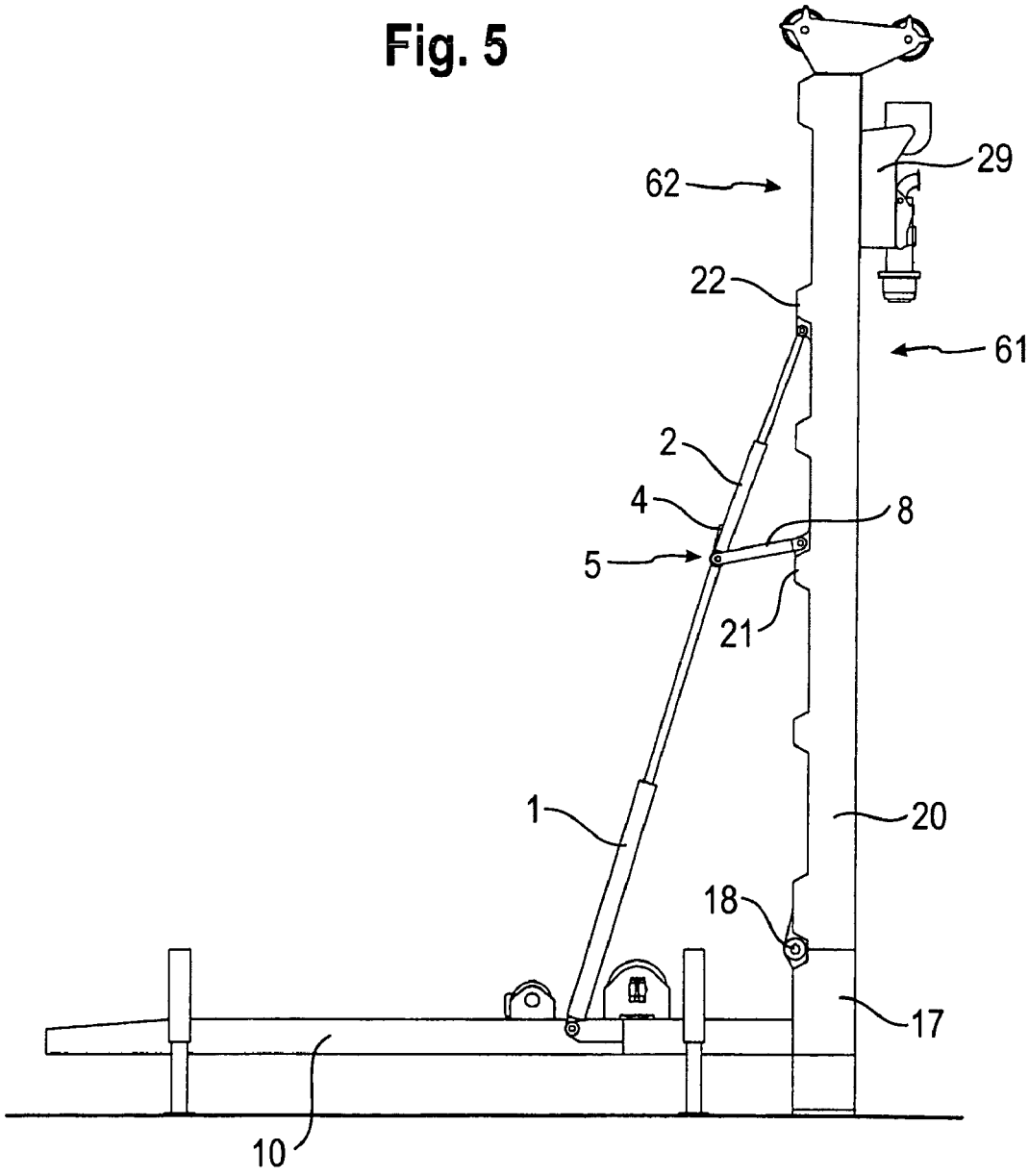
Figure 6:
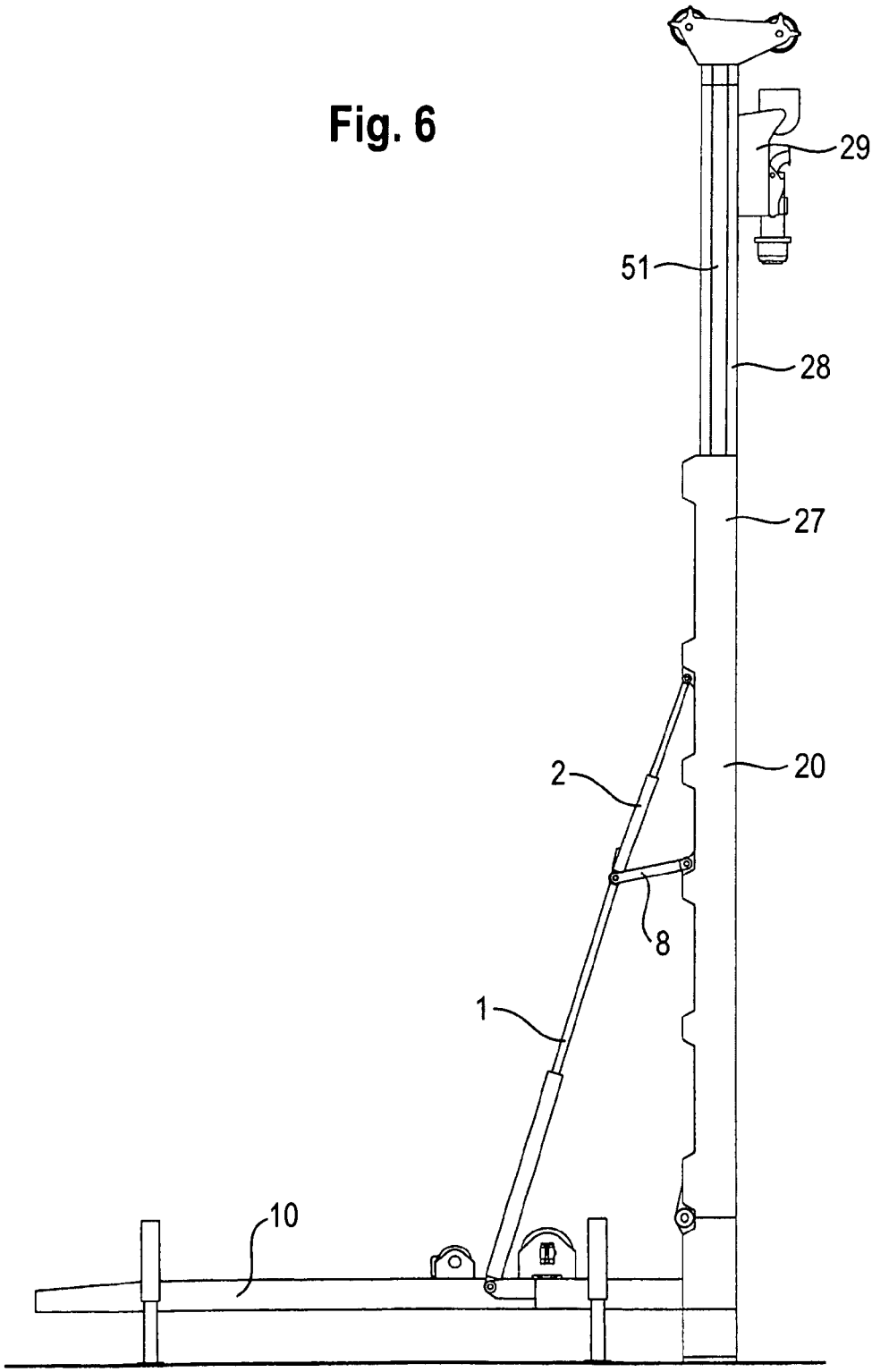

An embodiment of a construction apparatus according to the invention is shown in FIGS. 1 to 6 in different stages during the erection of the mast. FIG. 1 shows the mast in an approximately horizontal transport position, FIGS. 5 and 6 show it in a vertical operating position.

As shown for example in FIG. 1, the construction apparatus has a base carrier 10, which is designed as a frame extending in a substantially horizontal direction and which can be moved onto a vehicle, not shown here, for transport purposes. The base carrier 10 has a total of four extendable supports 15, by means of which the base carrier 10 rests on the ground 99.

Through a pivot joint 18 having a horizontal pivot axis a mast 20 is linked in a pivotable manner to the base carrier 10 between the transport position illustrated in FIG. 1 and the vertical operating position illustrated in FIGS. 5 and 6. On a front side 61 of the mast 20 a drilling sledge 29 is supported on the mast 20 by being displaceable longitudinally of the said mast 20. The drilling sledge 29 can have e.g. a rotary drive or a roto-percussive drive for a drill rod not illustrated in the Figures. For longitudinal displacement of the drilling sledge 29 along the mast 20 a rope winch 11 is arranged on the base carrier 10.

To erect the mast 20 from the transport position shown in FIG. 1 into the operating position shown in FIGS. 5 and 6 two hydraulic cylinders 1 and 2 are provided that are arranged in series. The first hydraulic cylinder 1 is linked on its one side to the base carrier 10 and on its opposite lying other side it is linked in a connecting section 5 to the second hydraulic cylinder 2. The second hydraulic cylinder 2 is in turn linked to the mast 20 on its side facing away from the first hydraulic cylinder 1 and the connecting section 5. The linkage of the first hydraulic cylinder 1 to the base carrier 10 is effected via the cylinder housing of the first hydraulic cylinder 1, whereas the linkage of the second hydraulic cylinder 2 to the mast 20 is effected via the piston rod of the second hydraulic cylinder 2, i.e. the connecting section 5 connects the piston rod of the first hydraulic cylinder 1 to the cylinder housing of the second hydraulic cylinder 2.

In order to prevent the connecting section 5 located between the two hydraulic cylinders 1 and 2 from bending outwards during the erection of the mast 20, a bar-shaped coupling rocker-arm 8 is provided which is linked on its one end to the mast 20 and on its other end to the two hydraulic cylinders 1 and 2 in the connecting section 5. The two hydraulic cylinders 1 and 2 and the coupling rocker-arm 8 are pivotably connected to one another about a common pivot axis 6 in the connecting section 5. The pivot axis of the pivot joint 18, the common pivot axis 6, the pivot axis of the linkage of the first hydraulic cylinder 1 to the base carrier 10, the pivot axis of the linkage of the second hydraulic cylinder 2 to the mast 20 and the pivot axis of the linkage of the coupling rocker-arm 8 to the mast 20 extend parallel to one another.

On a mast's rear side 62, which faces away from the mast's front side 61 and faces towards the first hydraulic cylinder 1 and also towards the base carrier 10 in the transport position depicted in FIG. 1, two projections 21 and 22 are provided on the mast 20. To the first projection 21 the coupling rocker-arm 8 is linked and to the second projection 22 the second hydraulic cylinder 2 is linked.

As shown in FIG. 1 in particular, in the transport position of the mast 20 the second hydraulic cylinder 2 extends at a very small angle with respect to the longitudinal axis 100 of the mast 20. Therefore the forces exerted by the second hydraulic cylinder 2 on the mast 20 act to a large degree parallel to the longitudinal axis 100 and only to a very small degree in a perpendicular fashion to the longitudinal axis 100 in the erecting direction 101. In order to ensure in this case, too, an especially effective force transmission from the first hydraulic cylinder 1 to the mast 20 in the erecting direction 101, a spacer 4 is provided which protrudes from the connecting section 5 and rests in the transport position illustrated in FIG. 1 with a front-side supporting surface 41 longitudinally on the mast 20. On its side facing away from the mast the spacer 4 is connected in the connecting section 5 by way of the pivot axis 6 to the two hydraulic cylinders 1 and 2 and can thus transfer the forces exerted by the first hydraulic cylinder 1 to the mast 20.

The spacer 4 is arranged at the end of the coupling rocker-arm 8, i.e. upon rotation of the coupling rocker-arm 8 relative to the mast 20 the spacer 4 co-rotates with the coupling rocker-arm 8, as illustrated for example in FIG. 4. As shown in FIG. 1, in the transport position of the mast 20 the spacer 4 extends approximately perpendicularly to the longitudinal axis 100 of the mast 20 and can therefore transmit forces acting in the erecting direction 101 particularly well.

In the transport position of the mast 20 the spacer 4 rests with its supporting surface 41 on a contact surface 24 that is formed on the mast 20 between the two projections 21 and 22 and therefore between the linkage point for the second hydraulic cylinder 2 and the linkage point for the coupling rocker-arm 8. The contact surface 24 is provided on the rear side 62 of the mast 20.

In FIGS. 1 to 5 the kinematics present during the erection of the mast 20 from the transport position into the operating position is shown.

As depicted in FIG. 1, in the transport position of the mast 20 the two hydraulic cylinders 1 and 2 are in an at least approximately aligned arrangement and the connecting section 5 is supported through the spacer 4 on the mast 20.

Figure 2:
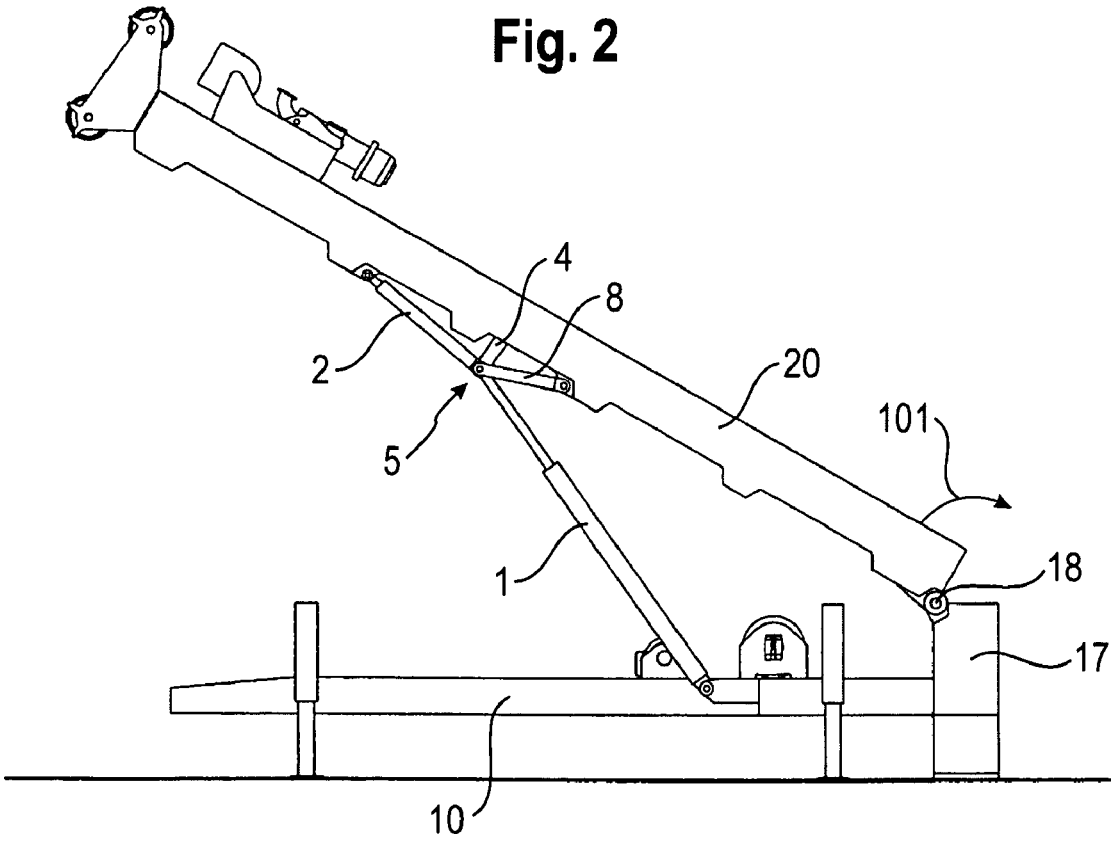

For erection of the mast 20 the first hydraulic cylinder 1 is operated and extended initially. The forces acting in this process are transmitted at least in part via the spacer 4 to the mast 20 so that the mast 20 is pivoted upwards in the erecting direction 101. The second hydraulic cylinder 2 remains retracted so that the spacer 4 continues to rest on the mast 20. This stage, in which the two hydraulic cylinders 1 and 2 leave their aligned arrangement is shown in FIG. 2.

The first hydraulic cylinder 1 is extended further until it has reached its maximum operating position. This state is shown in FIG. 3.

Once the first hydraulic cylinder 1 has reached its maximum stroke, the second hydraulic cylinder 2 is extended for further erection of the mast 20, as illustrated in FIG. 4. Through actuation of the second hydraulic cylinder 2 the relative dimensions of the triangle formed by the second hydraulic cylinder 2, the coupling rocker-arm 8 and the mast section between hydraulic cylinder 2 and coupling rocker-arm 8 change. In particular, the corner-point of the triangle, which is located remotely from the mast and coincides with the connecting section 5, is moved away from the mast 20. In doing so, the coupling rocker-arm 8 is pivoted relative to the mast 20. As a result, the spacer 4, which is connected in a rotationally fixed manner to the coupling rocker-arm 8 at the end of the coupling rocker-arm 8 facing away from the mast, is detached from the contact surface 24 of the mast 20 and is therefore no longer available for a force transmission.

The second hydraulic cylinder 2 is extended further, while the spacer 4 remains spaced from the mast 20. Finally, the second hydraulic cylinder 2 has also reached its maximum stroke. In this position, which is shown in FIG. 5, the mast 20 has reached its vertical operating position. In this operating position the two hydraulic cylinders 1 and 2 are located again in an at least approximately aligned arrangement.

As illustrated in particular in FIGS. 1 and 5, the base carrier 10 has a mast extension 17, on which the mast 20 rests in the vertical operating position and which extends the stroke of the drilling sledge 29. It is on this mast extension 17 that the pivot joint 18 is arranged.

As shown in FIG. 6, the mast 20 has a two-part telescopic design with a first, lower mast section 27 and a second, upper mast section 28, in which case the second mast section 28 can be telescoped into the first mast section 27. For displacement of the two mast sections 27 and 28 relative to each other a hydraulic cylinder 51 is provided that extends inside the two mast sections 27 and 28. Advantageously, the mast 20 is designed such that the drilling sledge 29 can be displaced longitudinally of the two mast sections 27 and 28.

The invention claimed is:

1. Construction apparatus comprising a base carrier, a mast which is arranged on the base carrier in a pivotable manner, a first hydraulic cylinder and a second hydraulic cylinder for erecting the mast, which are connected to each other in an articulated manner in a connecting section, the first hydraulic cylinder being linked to the base carrier and the second hydraulic cylinder being linked to the mast, and a coupling rocker-arm which is linked on one side to the mast and on another side to the connecting section, wherein in a part of the connecting section a spacer is arranged, through which the connecting section is supported on the mast in a detachable manner.

2. Construction apparatus according to claim 1, wherein the spacer is fixed to the connecting section in an articulated manner.

3. Construction apparatus according to claim 1, wherein the spacer is connected in a rotationally fixed manner to the coupling rocker-arm and the spacer can be pivoted relative to the first hydraulic cylinder and to the second hydraulic cylinder.

4. Construction apparatus according to claim 1, wherein the spacer is arranged at the end of the coupling rocker-arm.

5. Construction apparatus according to claim 1, wherein the spacer is formed integrally with the coupling rocker-arm.

6. Construction apparatus according to claim 1, wherein the spacer has at a front face a supporting surface for support on the mast.

7. Construction apparatus according to claim 1, wherein the two hydraulic cylinders and the coupling rocker-arm are linked to one another coaxially in the connecting section.

8. Construction apparatus according to claim 1, wherein the spacer extends at least approximately rectangularly to a longitudinal axis of the mast, when the connecting section is supported by the spacer on the mast.

9. Construction apparatus according to claim 1, wherein the mast has a first projection to which the coupling rocker-arm is linked, the mast has a second projection to which the second hydraulic cylinder is linked and a contact surface for the spacer is provided between the projections.

10. Construction apparatus according to claim 1, wherein the second hydraulic cylinder and the coupling rocker-arm are linked to the mast on a mast's rear side facing towards the first hydraulic cylinder and on a mast's front side facing away from the first hydraulic cylinder a drilling sledge is arranged which can be displaced longitudinally of the mast.

11. Construction apparatus according to claim 1, wherein the first hydraulic cylinder has a greater stroke than the second hydraulic cylinder and the spacer is designed shorter than the coupling rocker-arm.

* * * * *